United States Patent [19]

Ingalls et al.

[11] Patent Number: 4,799,536

[45] Date of Patent: Jan. 24, 1989

[54] SHEET CASTER COOLING

[75] Inventors: John P. Ingalls, Centerburg; Robert E. Maringer, Worthington; Ray D. Wood, Grove City, all of Ohio

[73] Assignee: Battelle Development Corporation, Columbus, Ohio

[21] Appl. No.: 97,488

[22] Filed: Sep. 16, 1987

[51] Int. Cl.[4] ..... B22D 11/06; B22D 11/124

[52] U.S. Cl. ..... 164/479; 164/485; 164/429; 164/443

[58] Field of Search ..... 164/463, 479, 429, 423, 164/485, 443, 428, 480

[56] References Cited

U.S. PATENT DOCUMENTS

| | | | |
|---|---|---|---|
| 2,561,636 | 7/1951 | Pyk . | |
| 4,452,298 | 6/1984 | Rahmfeld | 164/485 |
| 4,489,772 | 12/1984 | McLane et al. | 164/463 X |
| 4,706,734 | 11/1987 | Sevastakis | 164/443 |

FOREIGN PATENT DOCUMENTS

| | | | |
|---|---|---|---|
| 1364717 | 5/1964 | France . | |
| 55-86660 | 6/1980 | Japan | 164/423 |

OTHER PUBLICATIONS

Cygler and Wolf, "Continuous Strip and Thin Slab Casting of Steel–An Overview", (I&SM, Aug. 1986, pp. 27, 29).

*Primary Examiner*—Kuang Y. Lin

*Attorney, Agent, or Firm*—Barry S. Bissell

[57] ABSTRACT

A more uniform cooling system for direct strip forming processes on chilled drums wherein the drum 1 is hollow and is partially filled with a coolant pool 6. A central tube 7 provides coolant spray 8 to the portions of the drum interior when not covered with the coolant pool. Patterned cooling for thickness control is practiced by changing the heat conduction through the drum wall at selected locations.

8 Claims, 1 Drawing Sheet

SHEET CASTER COOLING

TECHNICAL FIELD

The invention relates to casting metal sheet directly from the melt onto a cylindrical casting drum. Presently, a layer of molten metal is metered to the outer surface of the rotating drum. The drum is generally cooled by means of a liquid coolant circulated through a labyrinth of cooling channels on the inside surface. The cooling effect to the outside casting surface is highly localized around the cooling channels and leads to relatively warmer and cooler areas, differential cooling and non-uniform sheet thickness.

On way to avoid the localized cooling is to provide a hollow drum having a pool of coolant therein free to contact the inside surface below the pool. Such design is shown in the August 1986 issue of I&SM at page 29, and in French Pat. No. 1,364,717 and U.S. Pat. No. 2,561,636. As shown in the latter, the pool covers the lower part of the drum inside surface when the drum is rotating at low speeds. The patent proposes a nozzle to spray the inside surface above the pool.

SUMMARY OF THE INVENTION

It is an object of the invention to provide a method and apparatus for casting uniform sheet directly from the melt.

It is also an object to provide a method and apparatus for casting sheet with a preselected thickness profile.

It is further an object to provide such a sheet casting method and apparatus by controlled cooling of the casting surface.

In accordance with the objectives, the invention is a method and apparatus for casting metal sheet with a selected thickness profile directly from the melt. The apparatus comprises a hollow, cylindrical casting drum having an outer casting surface, means for rotating the casting drum about the cylinder axis, tundish means for delivering a layer of molten metal to the casting surface, a liquid coolant pool in the interior of the hollow casting drum, means for maintaining a coolant level below about the cylinder axis, means for spraying a coolant liquid inside the casting drum against substantially the entire inside surface of the casting drum above the liquid level, and means for changing the heat transfer through the drum wall in selected locations. The heat transfer may be decreased by making the drum wall thicker, by insulating the wall or by changing the temperature of the spray at selected location. Higher temperature of the casting surface produces thinner sheet.

The method for sheet casting generally comprises rotating a hollow, cylindrical casting drum having an outer casting surface about a generally horizontal cylinder axis, controlling the heat transfer through the drum wall in a preselected manner, delivering a molten metal layer to the outer casting surface, cooling the interior of the casting drum by admitting a liquid coolant therein, maintaining a coolant liquid level below about the cylinder axis and spraying a liquid coolant inside the casting drum onto substantially the entire surface of the drum above the coolant liquid level.

DESCRIPTION OF THE PREFERRED EMBODIMENTS

The invention relates to direct metal forming of sheet on a chill surface. Such processes attempt to directly produce net shape or near net shape castings, thus avoiding costly rolling operations.

Figure 1:
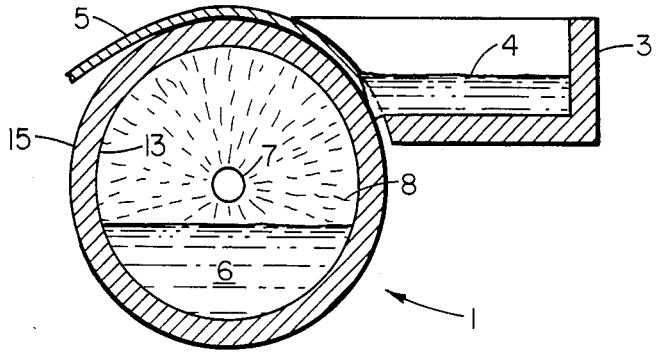
FIG. 1 is a sectional, side-elevation view of casting apparatus including coolant spraying means.
Figure 2:
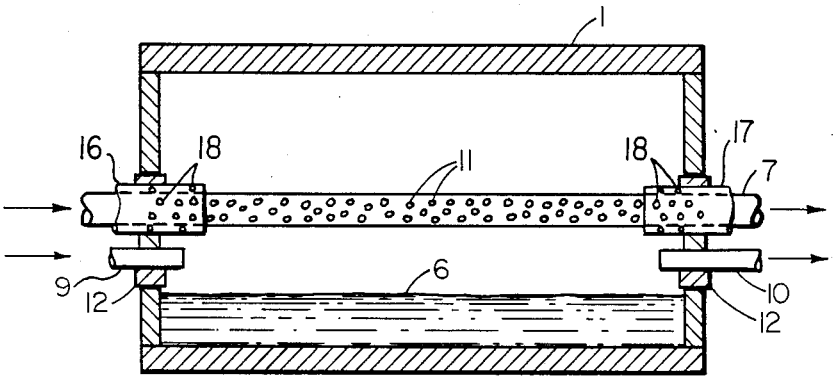
FIG. 2 is a sectional, front-elevation view of a casting drum.
Figure 3:
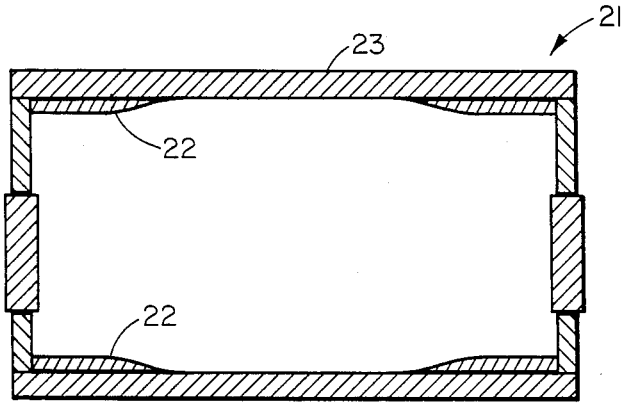
FIG. 3 is a sectional, front-elevation view of one embodiment of the invention for promoting differential cooling and a patterned thickness profile in the sheet.

As shown in FIGS. 2 and 3, a cylindrical drum 1 may be used to cast metal sheet 5. Molten metal 4 is held in a tundish 3 in close proximity to the casting drum. The molten metal typically contacts the outer casting surface 15 of the drum and solidifies to a rigid sheet before removal from the drum. The casting drum is rotated along the cylinder axis by conventional means. It is cooled by a pool of coolant 6 inside the drum. The coolant is unconstrained by cooling coils, for example, in the drum. Fresh coolant is typically constantly added and warm coolant removed. A perforated spray conduit 7 runs along the cylinder axis of the drum. Coolant is passed through the conduit and is sprayed through the perforations 11 onto substantially the entire inside surface 13 of the drum above the liquid level of the coolant pool 6. A second coolant may be simultaneously added through conduits 16 and 17 and perforations 18 and sprayed against selected portions (the drum ends in this case) of the inside surface. The second coolant may have a different temperature or composition, for example, to change the cooling characteristics across the drum surface. As shown best in FIG. 2, the coolant pool 6 may be expanded by additions through conduit 9 or through the perforated conduit 7. Coolant may be removed through conduit 10. These conduits may enter and exit the drum through fixed bearings 12. The drum may then rotate around the fixed bearing.

The liquid level of the coolant is preferably maintained at slightly below the cylinder axis and the perforated conduit 7 so that the perforations are open and able to spray coolant on the exposed drum inner surface. At high rotational speeds, centrifugal force will push the coolant against the entire inside surface. At slower speeds, however, the coolant tends to stay in the bottom portion of the drum. The coolant spray then continues to cool the upper surface area which is not covered by the coolant pool at slower speeds. It has been found that at slower speeds generally used for making sheet and in the absence of spraying over substantially the entire inside surface, nucleate boiling can occur on the uncovered surface. This causes adherent bubbles which, when rotated into the coolant pool, can prevent good coolant contact.

The invention allows good control over the cooling rate of the sheet. It also allows the patterned cooling of the wheel and thickness control of the sheet. For example, the heat transfer characteristics of the drum surface are altered locally to cause a change in the thickness of the sheet. In FIG. 3, segments 22 have been added to increase the thickness of the wall and to lower the heat transfer rate. The casting surface is therefore hotter in these areas and the sheet will be thinner. The design shown in FIG. 3 would be useful for casting a sheet with a thicker center strip or would at least compensate for the normally lower temperatures near the edges of the drum. The segments 22 can be conductive or insulating materials. If the former, the drum could be machined in that manner during manufacture. Or separate pieces of conductive or insulating materials could be selectively joined to the inside surface in selection location.

There are other ways to selectively change the heat transfer of the drum wall. One way is to spray only a portion of the inner wall, but it is preferred to provide at least two different temperature 'coolant' sprays in the interior of the drum at selected locations. A higher temperature spray would still prevent the deleterious bubble formation, but would reduce the heat transfer at such locations compared with the lower temperature spray.

Two different coolant compositions could also be used to selectively change the heat transfer characteristics. Different coolants or different temperature coolants may be added in any known manner, for example, as shown in FIG. 2.

We claim:

1. Apparatus for casting metal sheet from the melt comprising a hollow, cylindrical casting drum having a casting surface on its exterior, means for rotating the casting drum, about a substantially horizontal cylinder axis, tundish means adjacent the casting surface for delivering a layer of molten metal to the casting surface, a liquid coolant pool in the lower portion of the interior of the casting drum, means for maintaining the coolant pool level below about the cylinder axis, means for spraying a coolant liquid inside the casting drum against substantially the entire inside surface of the casting drum above the liquid level, and shaped inserts attached to the inside surface of the casting drum at selected locations for selectively controlling the heat transfer from the casting drum to the coolant at the selected locations along the inside surface of the casting drum to create a selected thickness profile in the cast sheet.

2. Apparatus for casting metal sheet from the melt comprising a hollow, cylindrical casting drum having a casting surface on its exterior, means for rotating the casting drum, about a substantially horizontal cylinder axis, tundish means adjacent the casting surface for delivering a layer of molten metal to the casting surface, a liquid coolant pool in the lower portion of the interior of the casting drum, means for maintaining the coolant pool level below about the cylinder axis, means for spraying a coolant liquid inside the casting drum against substantially the entire inside surface of the casting drum above the liquid level, and shaped inserts of insulating material attached to the inside surface of the casting drum at selected locations for selectively controlling the heat transfer from the casting drum to the coolant at the selected locations along the inside surface of the casting drum to create a selected thickness profile in the cast sheet.

3. The apparatus of claim 2 wherein the means for spraying a coolant liquid comprises spraying a first coolant at first selected locations along the inside surface of the casting drum and a second coolant over a second selected location along the inside surface.

4. The apparatus of claim 3 wherein the second coolant has a different composition from the first coolant.

5. The apparatus of claim 3 wherein the first coolant is of a different temperature than the second coolant when sprayed against the inside surface.

6. The method for sheet casting comprising rotating a hollow, cylindrical casting drum having an outer casting surface about a generally horizontal cylinder axis, delivering a molten metal layer to the outer casting surface, cooling the interior of the casting drum by admitting a liquid coolant therein, maintaining a coolant liquid level below about the cylinder axis and spraying a liquid coolant inside the casting drum onto substantially the entire surface of the drum above the coolant liquid level wherein the improvement comprises selectively controlling the heat transfer from the casting drum to the coolant at selected locations along the inside surface of the casting drum by spraying a first coolant liquid against preselected portions of the inside surface of the casting drum and a second coolant over preselected second portions of the inside surface to create a selected thickness profile in the cast sheet.

7. The method of claim 6 wherein the temperatures of the first coolant and the second coolant are adjusted to be different during spraying.

8. The method of claim 6 wherein the heat transfer is controlled by fixing selectively shaped inserts on the inside surface of the casting drum.

* * * * *